US007320158B2

(12) United States Patent
Deto et al.

(10) Patent No.: US 7,320,158 B2
(45) Date of Patent: Jan. 22, 2008

(54) FASTENER

(75) Inventors: Tatsuya Deto, Jakarta (ID); Eiji Gonda, Kurobe (JP); Toshitaka Inohara, Kurobe (JP); Miyuki Kirita, Kurobe (JP); Kosuke Tanaka, Kurobe (JP)

(73) Assignee: YKK Corporation, Tokyo (JP)

( * ) Notice: Subject to any disclaimer, the term of this patent is extended or adjusted under 35 U.S.C. 154(b) by 50 days.

(21) Appl. No.: 11/281,759

(22) Filed: Nov. 17, 2005

(65) Prior Publication Data

US 2006/0112523 A1 Jun. 1, 2006

(30) Foreign Application Priority Data

Nov. 30, 2004 (JP) ..... 2004-347007

(51) Int. Cl.
*A44B 19/00* (2006.01)
*A44B 19/02* (2006.01)
*A41F 1/00* (2006.01)

(52) U.S. Cl. ..... 24/303; 24/433

(58) Field of Classification Search ..... 24/303, 24/433

See application file for complete search history.

(56) References Cited

U.S. PATENT DOCUMENTS

| | | | | |
|---|---|---|---|---|
| 3,008,209 | A * | 11/1961 | Kurt | 24/303 |
| 3,266,112 | A * | 8/1966 | Heckman | 24/400 |
| 4,399,595 | A * | 8/1983 | Yoon et al. | 24/303 |
| 6,502,285 | B2 * | 1/2003 | Kiely | 24/433 |
| 6,826,810 | B2 * | 12/2004 | Ichikawa et al. | 24/433 |
| 2003/0213106 | A1 * | 11/2003 | Ichikawa et al. | 24/433 |
| 2005/0050699 | A1 * | 3/2005 | Yoneoka | 24/433 |

FOREIGN PATENT DOCUMENTS

| | | |
|---|---|---|
| JP | 60-261404 | 12/1985 |
| JP | 4-64209 | 6/1992 |

* cited by examiner

*Primary Examiner*—Robert J. Sandy
(74) *Attorney, Agent, or Firm*—Alston & Bird LLP

(57) ABSTRACT

A fastener has a pair of fastener tapes (1*a*, 1*b*) and two rows of individual magnetic elements (2*a*, 2*b*) mounted on the opposed inner longitudinal edges (7*a*, 7*b*) of the two fastener tapes (1*a*, 1*b*) at a predetermined interval. Each magnetic element (2*a*) mounted on one fastener tape (1*a*) is adapted to be fit between and cling to two mating magnetic elements (2*b*) mounted on the other fastener tape (1*b*).

7 Claims, 6 Drawing Sheets

FASTENER

CROSS-REFERENCES TO RELATED APPLICATIONS

The entire disclosure of Japanese patent application number 2004-347007 filed on Nov. 30, 2004 is incorporated herein by reference in its entirety.

BACKGROUND OF THE INVENTION

1. FIELD OF THE INVENTION

This invention relates to a fastener comprising a pair of fastener tapes and two rows of magnetic elements attached to the respective opposed inner longitudinal edges of the fastener tapes, the magnetic elements containing magnets, so that the magnetic elements are joined together via magnetism. The fastener can be used on an opening of the front of clothing.

2. DESCRIPTION OF THE RELATED ART

Heretofore, there has been known simple magnetic buttons that are attached to an opening of the front of clothing for opening and closing the opening of the front of clothing, etc. One example of magnetic button mechanism described is disclosed Japanese Laid-open Utility Model application No. 4-64209 and reproduced here in FIG. 9 of the drawings appended hereto. In this magnetic button mechanism, a row of H-cross-sectioned button sockets 107 are attached to an inner longitudinal edge 103*b* of one tape 101*b* of a pair of fastener tapes 101*a*, 101*b* at a uniform interval and a row of projecting buttons 105 are attached to an opposed inner longitudinal edge 103*a* of the other tape 101*a* in opposed relation to the button sockets 107. Each H-cross-sectioned button socket 107 has a magnet 109 mounted on its base portion, so that the projecting buttons 105 are magnetically attracted by the button sockets 107.

Another conventional magnetic fastener used on an opening of the front of clothing is disclosed in Japanese Laid-open Patent application No. 60-261404 and reproduced here in FIG. 10 of the drawings appended hereto. As shown in FIG. 10, this magnetic fastener comprises a pair rows of fastening elements 201*a*, 201*b* attached to the respective inner longitudinal edges of the opening of the clothing. Each fastener element 201*a*, 201*b* is in the cross-sectional shape of a short-legged T and has a magnet 205*a*, 205*b* attached to a yoke or a bar-like portion 203*a*, 203*b* of the fastener element 201*a*, 201*b* so that two rows of fastening elements 201*a*, 201*b* are pulled toward and cling to each other through magnetism perpendicularly of the plane of the clothing or in the plane of the clothing.

A still another magnetic fastener is disclosed in U.S. Pat. No. 4,399,595 and reproduced here in FIG. 11 of the drawings appended hereto. As shown in FIG. 11, the magnetic fastener comprises a pair of elongated strips 301*a*, 301*b* and two sets of magnets 303*a*, 303*b* incorporated in the strips 301*a*, 301*b*. These magnetic strips 301*a*, 301*b* are attached to the respective opposed edges of an opening formed in the front of clothing, so that the opposed edges of the clothing can be pulled toward and cling to each other though magnetism.

In all the magnetic fasteners described hereinabove, magnets are provided on the opposed edges of the opening of the front of the clothing, and the two rows of magnets are pulled toward each other either perpendicularly of the clothing surface or in the plane of clothing surface and cling together, so that the opening is closed magnetically. In the fastener shown in FIGS. 9 and 10, however, the opening are not fully closed, in other words, the opening are closed only at intervals or partly so that the opening which has been closed looks unsightly or ugly. Moreover, the fastener shown in FIG. 11 suffers from drawbacks that the opening edges of the strips 301*a*, 301*b* are overlapped and become thus thick and rigid.

In view of the above-mentioned drawbacks, an object of the present invention is to provide a magnetic fastener comprising a pair of fastener tapes; and two rows of magnetic elements mounted on the opposed inner longitudinal edges of the fastener tapes, the two magnetic element rows being symmetrical with regard of the longitudinal axis, the magnetic fastener being fastened on the opening edges, so that the magnetic element rows can be brought into and out of magnetic contact with each other very easily, the opening edges can be securely closed, and the magnetic fastener looks sightly.

SUMMARY

In accordance with the present invention, a fastener comprises a pair of fastener tapes and two rows of individual magnetic elements mounted on the opposed inner longitudinal edges of the two fastener tapes at a predetermined interval, so that each magnetic element mounted on one fastener tape is fit between and clings to mating magnetic elements mounted on the other fastener tape.

The fastener may further include two rows of positioning elements mounted on the opposed inner longitudinal edges of the fastener tapes, each positioning element being disposed between each adjacent magnetic elements.

In the fastener, each adjacent magnetic elements of one fastener tape is adapted to come into contact with the intermediate positioning element interposed therebetween, so that the adjacent magnetic elements are prevented from clinging to each other.

Each positioning element interposed between each adjacent magnetic elements may be adapted to be opposed to the mating magnetic element of the other fastener tape which is to be fit between said each adjacent magnetic elements. Each magnetic element may have a magnet embedded therein adjacent the distal end thereof. The magnetic elements are mounted on the inner longitudinal edges of the fastener tape with the poles of the magnet oriented longitudinally of the fastener tape.

When each magnetic element of one fastener tape is fit between each mating magnetic elements of the other fastener tape, the magnetic elements of both fastener tapes are joined to each other with the poles of the magnets oriented longitudinally of the fastener tapes.

The magnetic element may be molded with a magnet embedded in a synthetic resin material through an insert molding method.

The fastener further may include a separable end member which comprises a pair of separable end parts mounted on the lower ends of the magnetic element rows mounted on the respective inner longitudinal edges of the fastener tapes. The separable end parts are rotatable relative to each other so as to come into and out of fitting engagement with each other.

DRAWINGS—FIGURES

DRAWINGS—REFERENCE NUMERALS

Figure 1:
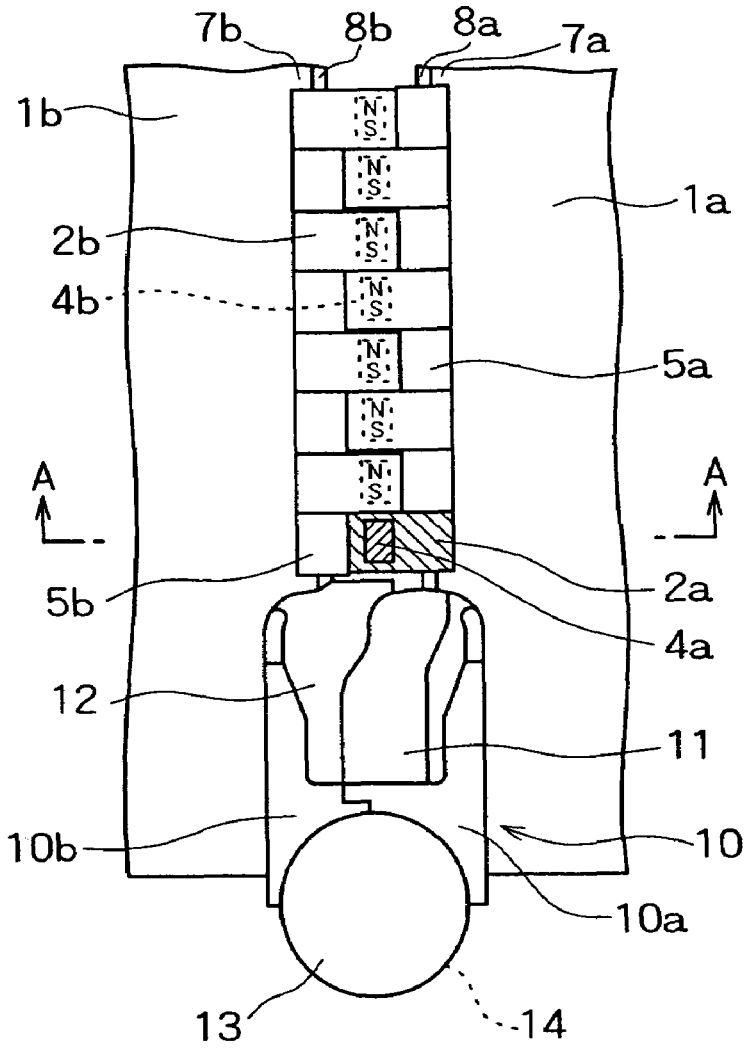
FIG. 1 is a front view of a magnetic fastener according to the first embodiment of the present invention, showing it in closed disposition.
Figure 2:
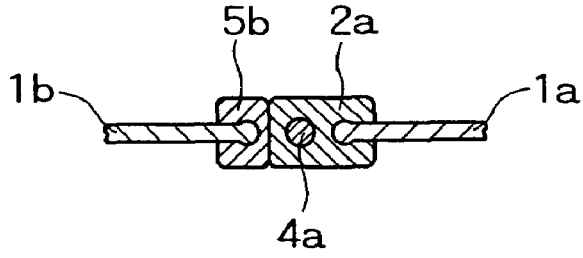
FIG. 2 is a cross-sectional view taken on line A-A of FIG. 1.
Figure 3:
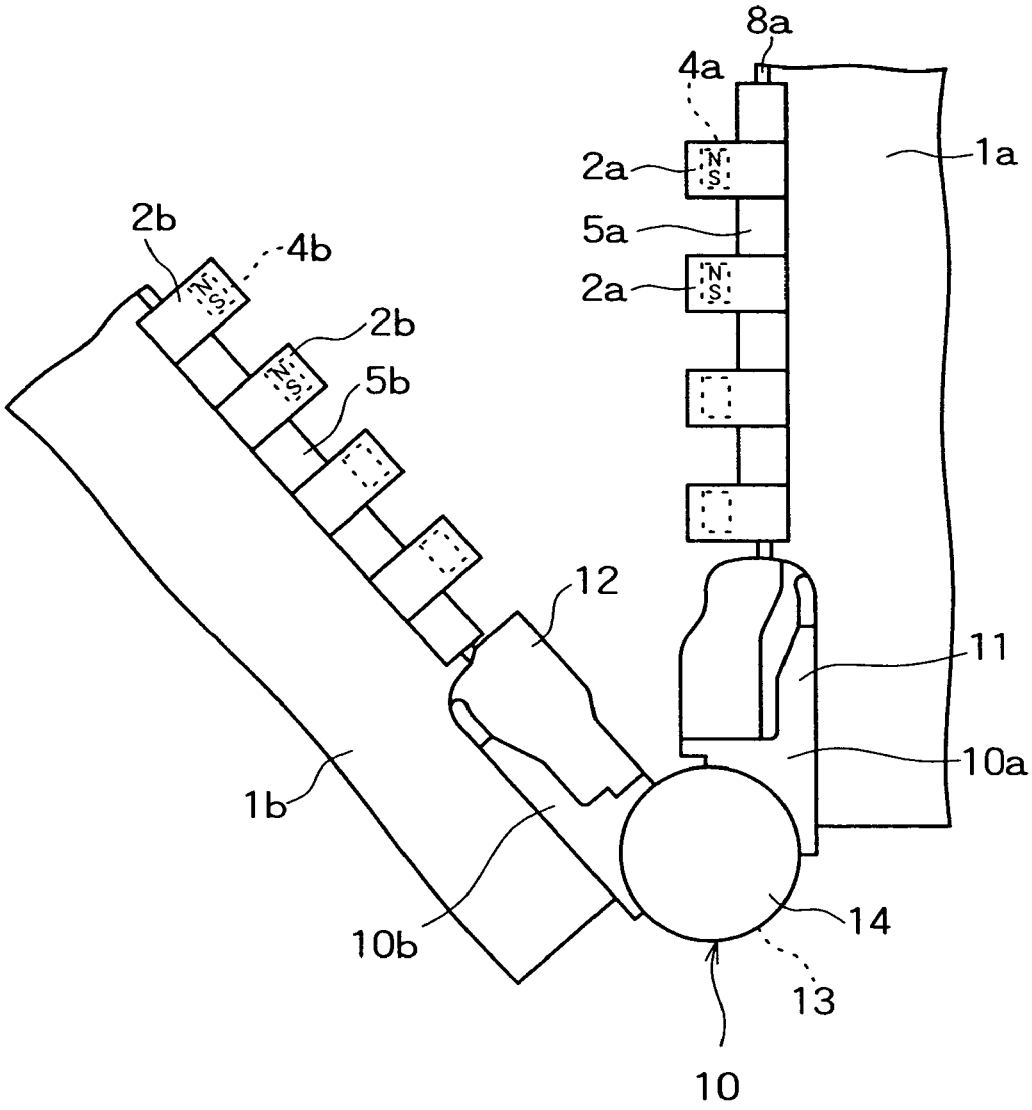
FIG. 3 is a front view showing the magnetic fastener of FIG. 1 in open disposition.

1 Fastener tape
2 Magnetic element
3 Synthetic resin
4 Bar magnet
5 Positioning element
7 Inner longitudinal edge
10 Separable end member

DETAILED DESCRIPTION

A fastener according to the present invention comprises a pair of fastener tapes 1*a*, 1*b*, and two rows of individual magnetic elements 2*a*, 2*b* mounted along the respective opposed inner longitudinal edges 7*a*, 7*b* of the fastener tapes 1*a*, 1*b*. Each individual magnetic element 2*a*, 2*b* is insert-molded from thermoplastic or thermosetting synthetic resins with a bar magnet 4*a*, 4*b* embedded therein. The bar magnet 4*a*, 4*b* is embedded in the distal end of the individual magnetic element 2*a*, 2*b*, namely in the portion that projects from the proximal end in which the magnetic element 2*a*, 2*b* is attached to the inner longitudinal edge 7*a*, 7*b* of the fastener tape 1*a*, 1*b*, with its poles oriented longitudinally of the fastener tape 1*a*, 1*b*. Instead of producing magnetic elements 2*a*, 2*b* with bar magnets 4*a*, 4*b* embedded in synthetic resin material, the magnetic elements 2*a*, 2*b* may be molded from synthetic resin material blended with magnetic powder. Alternatively, the magnetic elements 2*a*, 2*b* can be made by applying magnetic paint having magnetic powder mixed therewith on the outer surface of the synthetic resin material.

Two rows of positioning elements 5*a*, 5*b* are molded one on the inner longitudinal edge 7*a*, 7*b* of each fastener tape 1*a*, 1*b*, with each positioning element 5*a*, 5*b* disposed between its respective adjacent magnetic elements 2*a*, 2*b*. The positioning element 5*a*, 5*b* is slightly less in width than the magnetic element 2*a*, 2*b*. When the two rows of magnet elements 2*a*, 2*b* of both fastener tapes 1*a*,1*b* are joined together, the magnetic elements 2*a* molded on one tape 1*a* are arranged alternately with the magnetic elements 2*b* molded on the other tape 1*b*, in other words, each magnetic element 2*a* of one tape 1*a* is fitted between and clings to two complementary or mating magnetic elements 2*b* of the other tape 1*b*, whereby the two fastener tapes 1*a*, 1*b* are joined together.

Figure 4:
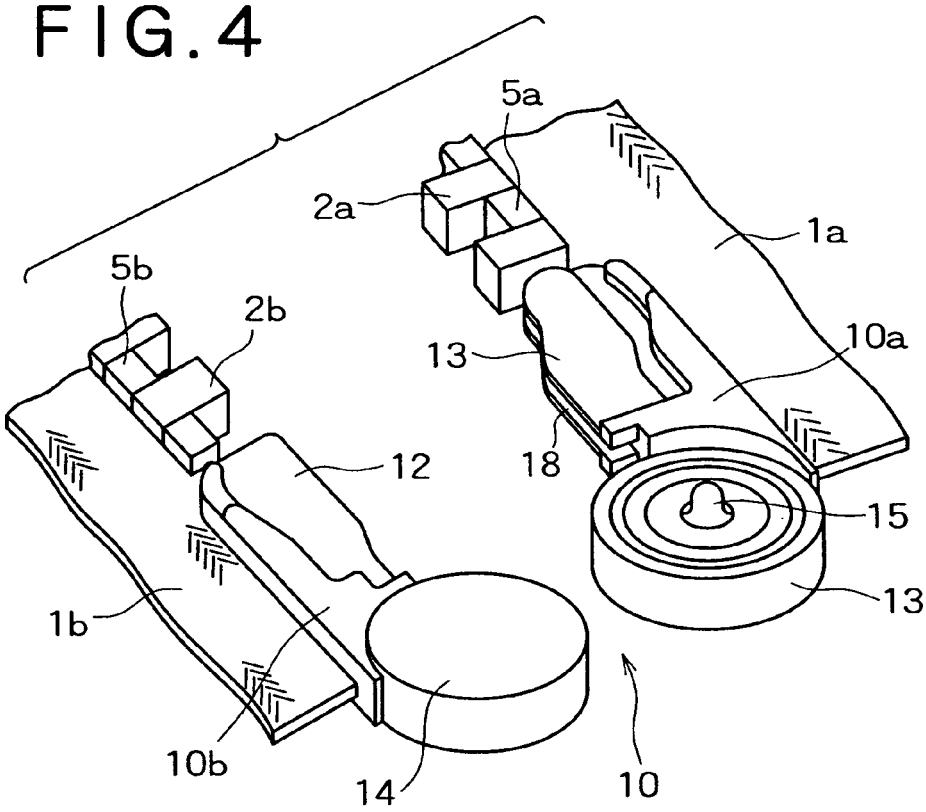
FIG. 4 is a perspective view of a separable end member attached to a lower end of the fastener tapes of the fastener of FIG. 1.

A separable end member 10 is molded on the lower end of the fastener tapes 1*a*, 1*b* contiguously to the lowermost magnetic element 2*a*. The separable end member 10 is comprised of a pair of male and female separable end parts 10*b*, 10 *a*. The female separable end part 10 *a* has a retaining member 11 and a first circular rotary plate 13 formed on the lower end of the retaining member 11. As better shown in FIG. 4, the retaining member 11 has a groove 18 formed on an inner side thereof A projection 15 is formed centrally on the front surface of the first circular rotary plate 13 and a first magnetic disk 17 is applied thereto around the projection 15. The male separable end part 10*b* has a plate-like insert portion 12 and a second circular rotary plate 14 formed on the lower end of the insert portion 12. The plate-like insert portion 12 of the male separable end part 10*b* is adapted to fit into the groove 18 of the retaining member 11 of the female separable end part 10 *a*. The second circular rotary plate 14 has a hole (not shown) formed centrally in the rear surface thereof and adapted to receive the projection 15. Likewise, a second magnetic disk (not shown) is applied to the front surface of the second circular rotary plate 14 around the hole (not shown). The first and second circular rotary plates 13, 14 of the two fastener tapes 1*a*, 1*b* are first brought into registry with each other with the projection 15 of the first circular rotary plate 13 fit into the hole of the second circular rotary plate 14. In this disposition, the first and second circular rotary plates 13, 14 are then rotated relative to each other until the insert member 12 comes into fitting engagement with the groove 18 of the retaining member 11, so that each magnetic element 2*a* of one fastener tape 1*a* is inserted between its respective two mating magnetic elements 2*b* of the other fastener tape 1*b* and the two rows of magnetic elements 2*a*, 2*b* of both fastener tapes 1*a*, 1*b* cling together by the magnets 4*a*, 4*b*, whereby the fastener is accurately closed. In order to separate the joined fastener tapes 1*a*, 1*b*, the magnetic elements 2*a* of one fastener tape 1*a* is separated from those 2*b* of the other fastener tape 1*b* one after another and then the first and second circular rotary plates 13, 14 are rotated relative to each other and thus the female separable end part 10*a* and the male separable end part lob are fully separated from each other. Consequently, the fastener tapes 1*a*, 1*b* can be separated.

The construction of the magnetic fastener according to the first embodiment of the present invention shown in FIGS. 1 through 5 is specifically described below. The two rows of individual magnetic elements 2*a*, 2*b* are attached to the inner longitudinal edges 7*a*, 7*b* of the respective fastener tapes 1*a*, 1*b*. The individual magnetic elements 2*a*, 2*b* are made of synthetic resin such as thermoplastic resins such as polyamide, polyacetal, polypropylene, polybutylene terephthalate or thermosetting resins such as uria resin, melamine resin and injection-molded on the inner longitudinal edge 7*a*, 7*b* of each fastener tape 1*a*, 1*b*. When each individual magnetic element 2*a*, 2*b* is injection-molded, the magnet 4 is embedded in the distal end of the magnetic element 2*a*, 2*b* namely in the portion that projects from the proximal end in which the magnetic element 2*a*, 2*b* is attached to the inner longitudinal edge 7*a*, 7*b* of the fastener tape 1*a*, 1*b*, with its poles oriented longitudinally of the fastener tape 1*a*, 1*b*. Specifically, the magnets 4*a*, 4*b* are embedded in the magnetic elements 2*a*, 2*b* with their same poles oriented in the same direction. For example, as shown in FIG. 1, the south poles of the magnets 4*a*, 4*b* are all oriented in the direction of the separable end member 10 and the north poles thereof are oriented in the opposite direction. With the poles of the magnets 4*a*, 4*b* thus oriented, when one magnetic element 2*a* of one fastener tape 1*a* is fit between two adjacent magnetic elements 2*b* of the other fastener tape 1*b*, the south pole of said one magnetic element 2*a* clings to the north pole of one of said two magnetic elements 2*b* and the north pole of said one magnetic element 2*a* clings to the south pole of the other magnetic element 2*b*. All the magnetic elements 2*a*, 2*b* of the two fastener tapes 1*a*, 1*b* cling to each other in this manner, so that the fastener tapes 1*a*, 1*b* join with each other or close. In addition to magnets 4*a*, 4*b* being thus insert-injection-molded into magnetic elements 2*a*, 2*b*, as mentioned hereinabove; magnetic elements 2*a*, 2*b* may be provided by first injection-molding precursor elements from synthetic resin material and thereafter fitting magnets 4*a*, 4*b* into the precursor elements.

Figure 5:
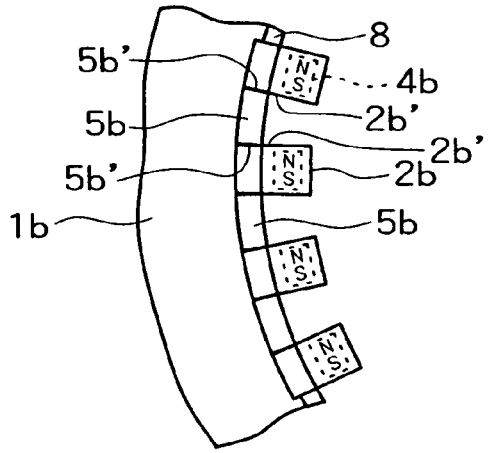
FIG. 5 is a fragmentary front view showing the way that the fastener tape of the fastener of FIG. 1 is curved into arcuate shape.

The individual magnetic elements 2*a*, 2*b* are injection-molded from synthetic resin on the inner longitudinal edge 7*a*, 7*b* of the fastener tape 1*a*, 1*b*. Specifically, individual magnetic elements 2*a*, 2*b* are molded on a bulged core member 8*a*, 8*b* formed on the inner longitudinal edge 7*a*, 8*b* of the fastener tape 1*a*, 1*b* at a predetermined uniform interval that is, with a uniform interval which is slightly greater than the width of the mating magnetic element 2*b*, 2*a* on the other fastener tape 1*b*, 1*a* which is to be inserted into the interval. The width of the magnetic element 2*a*, 2*b* means a dimension of the magnetic element 2*a*, 2*b* measured along the length of the fastener tape 1*a*, 1*b*. Two rows of positioning elements 5*a*, 5*b* are molded one on the inner longitudinal edge 7*a*, 7*b* of each fastener tape 1*a*, 1*b*, with a positioning element 5*a*, 5*b* interposed between each adjacent magnetic elements 2*a*,2*a*; 2*b*,2*b*. The positioning elements 5*a*, 5*b* are made of non-magnetic synthetic resin, molded separately from the magnetic elements 2*a*, 2*b*, and intended to position the magnetic elements 2*a*, 2*b* accurately. Each positioning element 5*a*, 5*b* is equal to or slightly less than each magnetic element 2*a*, 2*b* in length. As shown in FIG. 5, when each adjacent magnetic elements 2*b*, 2*b* of one fastener tape 1*b* are pulled toward each other by magnetism, the respective opposed sides 2*b*', 2*b*' of the two adjacent magnetic elements 2*b*, 2*b* come into contact with the opposed sides 5*b*', 5*b* ' of the intermediate positioning element 5*b* interposed therebetween, which prevents the adjacent magnetic elements 2*b*, 2*b* from clinging to each other.

The separable end member 10 of synthetic resin is injection-molded continuously on the lower end of the two rows of magnetic elements 2*a*, 2*b*attached to the inner longitudinal edges 7*a*, 7*b* of the two fastener tapes 1*a*, 1*b*. The separable end member 10 is better shown in FIG. 4. The female separable end part 10 *a* is injection-molded on the inner longitudinal edge 7*a* of one fastener tape 1*a* contiguously to the lowermost magnetic element 2*a*. The female separable end part 10 *a* includes the retaining member 11 which has the groove 18 formed on the inner side thereof and the first circular rotary plate 13 formed at the lower end of the retaining member 11. The projection 15 is formed centrally on the front surface of the first circular rotary plate 13 and the first magnetic disk 17*a* is embedded in the circular rotary plate 13 around the projection 15. The male separable end part 10*b* is injection-molded on the inner longitudinal edge 7*b* of the other fastener tape 1*b* contiguously to the lowermost positioning element 5*b*. The male separable end part 10*b* includes the plate-like insert member 12 disposed contiguous to the lowermost positioning element 5*b* and the second circular rotary plate 14 formed on the lower end of the insert member 12. The plate-like insert portion 12 is adapted to fit into the groove 18 of the retaining member 11. The second circular rotary plate 14 has the hole formed centrally in the rear surface thereof and adapted to receive the projection 15 of the first circular rotary plate 13 therein. Likewise, the second magnetic disk (not shown) is embedded in the rear side of the second circular rotary plate 14 around the hole, so that the second magnetic disk of the second circular rotary plate 14 is adapted to cling to the magnetic disk 17 of the first circular rotary plate 13 with the projection 15 fit into the hole.

Now description is made to how to use the fastener. The first and second circular rotary plates 13, 14 of the two fastener tapes 1*a*, 1*b* are first brought into registry with each other with the projection 15 of the first circular rotary plate 13 fit into the hole of the second circular rotary plate 14. Then, the first and second circular rotary plates 13, 14 are rotated relative to each other, to thus bring the insert member 12 into fitting engagement with the groove 18 of the retaining member 11 and to simultaneously fit each magnetic element 2*a* of one fastener tape 1*a* between the two mating magnetic elements 2*b*, 2*b* of the other tape 1*b*, thereby making the rows of magnetic elements 2*a*, 2*b* of both fastener tapes 1*a*, 1*b* cling together by magnetism, so that the two fastener tapes 1*a*, 1*b* are joined together. Since the positioning element 5*a*, 5*b* is interposed between each adjacent magnetic elements 2*a*, 2*a*; 2*b*, 2*b*, once one magnetic element 2*a* of one fastener tape 1*a* is positioned, the remaining magnetic elements 2*a* can be accurately inserted between their respective mating magnetic elements 2*b*, 2*b* of the other fastener tape 1*b*. In order to separate the closed fastener tapes 1*a*, 1*b*, the magnetic elements 2*a* of one fastener tape 1*a* is separated from those of the other fastener tape 1*b* one after another, then the first and second circular rotary plates 13, 14 are rotated relative to each other and are fully separated. Consequently, the fastener tapes 1*a*, 1*b* are fully separated.

Figure 6:
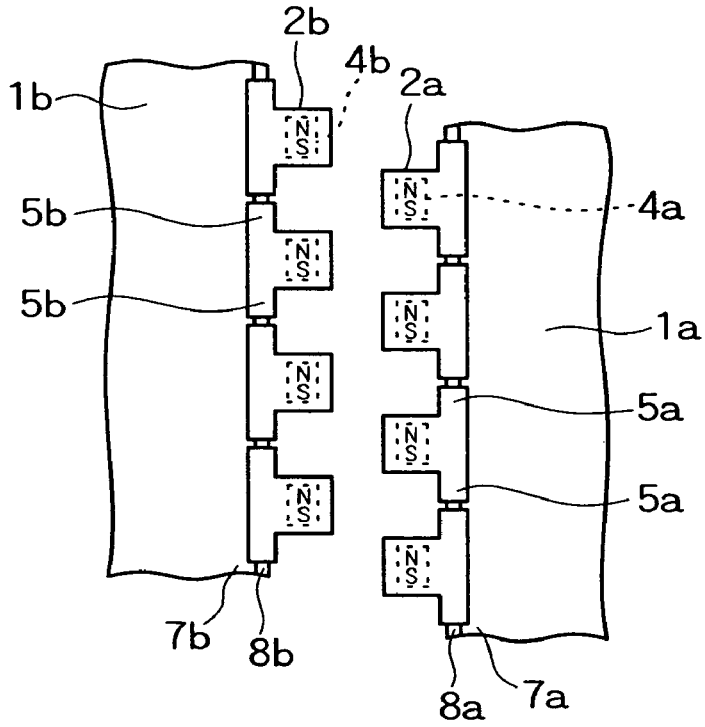
FIG. 6 is a front view of the magnetic fastener according to the second embodiment of the present invention, showing it in open disposition.
Figure 7:
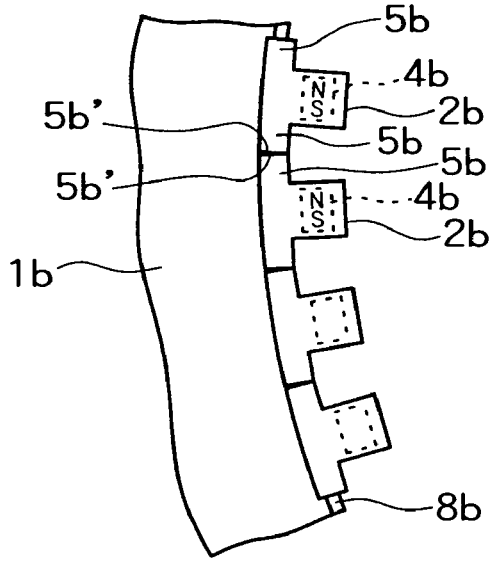
FIG. 7 is a fragmentary front view showing that the fastener tape of FIG. 6 is curved into arcuate shape.

FIGS. 6 and 7 shows a magnetic fastener according to the second embodiment of the present invention. Likewise, this magnetic fastener has two rows of individual magnetic elements 2*a*, 2*b* molded on the core members 8*a*, 8*b* formed on the respective opposed inner longitudinal edges 7*a*, 7*b* of a pair of fastener tapes 1*a*, 1*b*, through injection molding. Each individual magnetic element 2*a*, 2*b* has a bar magnet 4*a*, 4*b* embedded in the distal end thereof with its poles oriented longitudinally of the fastener tapes 1*a*, 1*b*. Instead of providing separate positioning elements 5*a*, 5*b*, two positioning portions 5*a*, 5*b* are formed integrally on the opposed sides of the proximal end of each magnetic element 2*a*, 2*b*. The positioning portions 5*a*, 5*b* are formed on the core members 8*a*, 8*b* provided on the respective opposed inner longitudinal edges 7*a*, 7*b* of the fastener tapes 1*a*, 1*b* so as to project longitudinally of the fastener tapes 1*a*, 1*b* beyond the opposed sides of the distal end portion of the magnetic elements 2*a*, 2*b* where the magnets 4*a*, 4*b* are embedded. Each positioning portion 5*a*, 5*b* extends half the width of the magnetic element 2*a*, 2*b* longitudinally of the fastener tape 1*a*, 1*b*. As clearly shown in FIG. 7, when each adjacent magnetic elements 2*b*, 2*b* of one fastener tape 1*b* are pulled toward each other by magnetism, the respective opposed sides 5*b*', 5*b*' of the opposed positioning portions 5*b*, 5*b* of the two adjacent magnetic elements 2*b*, 2*b* come into contact with each other, which prevents the adjacent magnetic elements 2*b*, 2*b* from clinging to each other.

Figure 8:
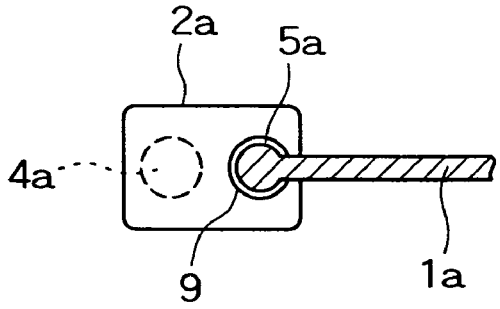
FIG. 8 is a cross-sectional view showing a modification of a positioning element.
Figure 9:
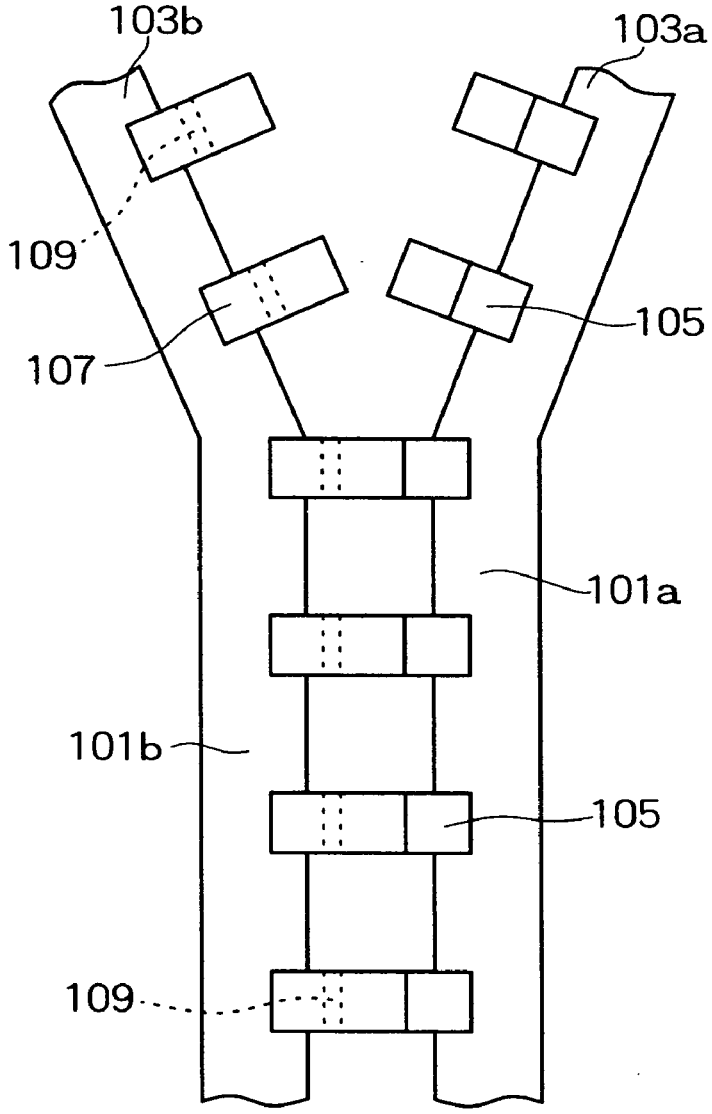
FIG. 9 PRIOR ART
FIG. 9 is a front view showing a conventional fastener using magnetism.
Figure 10:
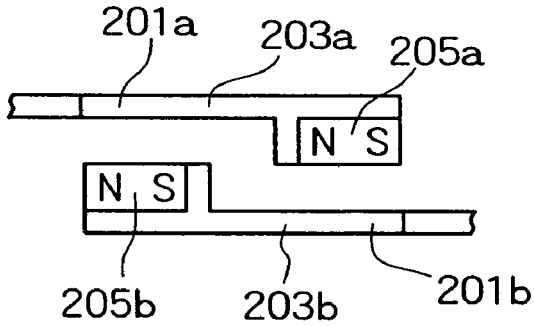
FIG. 10 PRIOR ART
FIG. 10 is a cross-sectional view showing another conventional fastener using magnetism.
Figure 11:
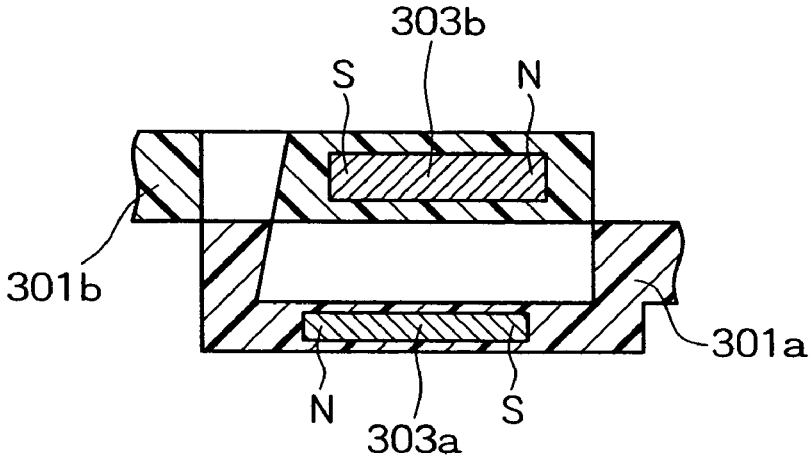
FIG. 11 PRIOR ART
FIG. 11 is a cross-sectional view showing still another conventional fastener using magnetism.

Instead of forming two positioning portions 5*a*, 5*b* integrally one on each opposed side of the magnetic element 2*a*, 2*b*, only one positioning portion may be formed on only one side of each magnetic element 2*a*, 2*b*. Alternatively, a tubular layer 9 may be provided as a positioning element 5*b* adjacent to each magnetic element 2*b* by applying liquid synthetic resin to the outer surface of the core member 8*a* formed on the inner longitudinal edge 7*a* of the fastener tape 1*a*, as shown in FIG. 8.

Advantages:

From the description above, a number of advantages of the magnetic fastener become evident:

Since the two rows of individual magnetic elements are symmetrical to each other; in order to make the magnetic fastener according to the present invention, one must only attach a row of magnetic elements to one longitudinal edge of a single elongated fastener tape, sever the elongated fastener tape having the magnetic element row attached thereto into a number of individual fastener tapes of a product length and join the two individual fastener tapes. Thus, the magnetic fastener is very easy to make and looks pleasant. Furthermore, since each magnetic element mounted on one fastener tape can be inserted between and cling to the two mating elements mounted on the other fastener tape, the magnetic elements of both fastener tapes can be joined with each other reliably and easily.

Furthermore, the magnetic elements can be disposed and mounted on the inner longitudinal edge of the fastener tape at accurate interval, so that the magnetic elements can cling to each other smoothly and easily.

Since each positioning element of one fastener tape is firmly mounted on the inner longitudinal edge thereof and disposed in opposed relation to the corresponding magnetic element of the other fastener tape, a sightly magnetic fastener can be produced.

Since the magnetic elements are arranged properly on the inner longitudinal edge of the fastener tape and the magnetic attraction is carried out not laterally but longitudinally of the fastener, the magnetic elements of both fastener tapes can be joined accurately.

Moreover, one can produce magnetic elements adapted to various uses very easily.

The fastener tapes carrying the rows of magnetic elements can be joined with and separated from each other through magnetism very smoothly and accurately. Furthermore, this fastener is very easy to manipulate.

The magnetic fastener according to the present invention is applied to the opening of a garment or a bag, so that the opening can be opened and closed by attraction of the magnets.

Conclusion, Ramifications, and Scope:

Although the description above contains many specificities, these should not be construed as limiting the scope of the invention but as merely providing illustrations of some of the presently preferred embodiments of this invention. For example, as stated earlier, alternatively, the magnetic elements can be molded of synthetic resins blended with magnetic powder. Furthermore, the magnetic elements can be made by applying magnetic paint having magnetic powder mixed therewith on the outer surface of the synthetic material. Although the fastener tapes described herein above is of the type having a separable end member provided on the lower end thereof, the lower end of the fastener tapes may be unseparably connected by a bottom end stop.

Thus the scope of the invention should be determined by the appended claims and their legal equivalents, rather than by the examples given.

What is claimed is:

1. A fastener comprising a pair of fastener tapes and two rows of individual magnetic elements each arranged in a row at a predetermined interval along a length of mounted on the opposed inner longitudinal edges of the two fastener tapes in a plane of the fastener with their poles oriented longitudinally of the fastener tapes, each magnetic element mounted on one fastener tape being adapted to fit entirely between and cling to two mating magnetic elements mounted on the other fastener tape.

2. A fastener recited in claim 1, wherein the fastener further includes two rows of positioning elements mounted on the opposed inner longitudinal edges of the fastener tapes, each positioning element being disposed between each adjacent magnetic elements.

3. A fastener recited in claim 2, wherein each adjacent magnetic elements of one fastener tape is adapted to come into contact with the positioning element interposed therebetween, so that the adjacent magnetic elements are prevented from clinging to each other.

4. A fastener recited in claim 1, wherein the fastener further includes two rows of positioning elements mounted on the opposed inner longitudinal edges of the fastener tapes, each positioning element being interposed between each adjacent magnetic elements and adapted to be opposed to the mating magnetic element of the other fastener tape which is to be fit between said each adjacent magnetic elements.

5. A fastener recited in claim 1, wherein each magnetic element has magnet embedded therein adjacent the distal end thereof with the north pole directed to one end of the fastener tapes and the south pole directed to the other end of the fastener tapes longitudinally of the fastener tapes; when each magnetic element of one fastener tape is fit between and clings to each mating magnetic elements of the other fastener tape, the magnetic elements of both fastener tapes being joined to each other with the north pole directed to one end of the fastener tapes and the south pole directed to the other end of the fastener tapes longitudinally of the fastener tapes.

6. A fastener recited in claim 5, the magnetic elements of both fastener tapes being joined to each other with the poles of the respective magnet oriented and aligned longitudinally of the fastener tapes.

7. A fastener recited in claim 1, wherein each magnetic element has a magnet embedded therein adjacent the distal end thereof with the north pole directed to one end of the fastener tapes and the south pole directed to the other end of the fastener tapes longitudinally of the fastener tapes; when each magnetic element mounted on one fastener tape is fitted between and clings to two mating magnetic elements mounted on the other fastener tape, the magnets being arranged with alternate north poles and south poles along the length of the fastener tapes.

* * * * *